US012007196B2

(12) United States Patent
Acquah

(10) Patent No.: US 12,007,196 B2
(45) Date of Patent: Jun. 11, 2024

(54) WEAPON GRIP ACCESSORY ATTACHMENT SYSTEM

(71) Applicant: Michael Kofi Mensah Acquah, Lethbridge (CA)

(72) Inventor: Michael Kofi Mensah Acquah, Lethbridge (CA)

( * ) Notice: Subject to any disclaimer, the term of this patent is extended or adjusted under 35 U.S.C. 154(b) by 0 days.

(21) Appl. No.: 17/735,839

(22) Filed: May 3, 2022

(65) Prior Publication Data

US 2022/0390204 A1 Dec. 8, 2022

Related U.S. Application Data

(60) Provisional application No. 63/196,915, filed on Jun. 4, 2021.

(51) Int. Cl.
*F41C 27/16* (2006.01)
*F41C 23/16* (2006.01)

(52) U.S. Cl.
CPC ..... *F41C 27/16* (2013.01); *F41C 23/16* (2013.01)

(58) Field of Classification Search
CPC ..... F41C 27/00; F41C 27/16; F41C 27/18; F41C 23/16; F41C 23/10
USPC ..... 42/90, 86
See application file for complete search history.

(56) References Cited

U.S. PATENT DOCUMENTS

| | | | | |
|---|---|---|---|---|
| 1,315,503 | A * | 9/1919 | Hughes | B26B 1/046 30/298 |
| 2,353,557 | A * | 7/1944 | Guthrie | B26B 27/007 30/298 |
| 3,981,526 | A * | 9/1976 | Lundqvist | A63B 29/08 30/298 |
| 9,468,285 | B2 * | 10/2016 | Martinez | A45C 13/30 |
| 9,618,299 | B1 * | 4/2017 | Gingrich | F41C 27/18 |
| 9,651,336 | B2 * | 5/2017 | Ringgenberg | F41A 17/02 |
| 10,247,520 | B2 * | 4/2019 | Manly | F41C 27/18 |
| 10,264,872 | B2 * | 4/2019 | Kim | B25F 1/04 |
| 10,458,747 | B2 * | 10/2019 | Ringgenberg | F41A 17/00 |
| 2005/0198872 | A1 * | 9/2005 | Correa | F41C 33/041 36/136 |
| 2012/0005930 | A1 * | 1/2012 | Cragg | F41C 23/16 42/1.06 |
| 2015/0168098 | A1 * | 6/2015 | Ringgenberg | F41A 17/02 24/3.2 |
| 2017/0234651 | A1 * | 8/2017 | Jones | F41G 1/383 42/143 |
| 2019/0128629 | A1 * | 5/2019 | Murphy, II | F41A 17/22 |
| 2019/0331447 | A1 * | 10/2019 | Murphy, II | F41A 17/48 |
| 2020/0253188 | A1 * | 8/2020 | Lynch | A45F 5/021 |
| 2023/0030981 | A1 * | 2/2023 | Woodbury | F41A 23/02 |

* cited by examiner

*Primary Examiner* — Jonathan C Weber
(74) *Attorney, Agent, or Firm* — Spencer Fane, LLP

(57) ABSTRACT

A system for removably attaching accessories to the grip of a hand weapon such as a pistol or rifle. The system has at least one magnet for attracting and retaining the accessory and at least one hook-and-loop fastener for further retaining the accessory and reducing any rotation of the accessory. The system may be an after-market product mountable to an existing weapon and accessory, wherein the components may be mounted using an adhesive, or it may be part of an original manufactured handle or weapon.

25 Claims, 6 Drawing Sheets

WEAPON GRIP ACCESSORY ATTACHMENT SYSTEM

TECHNICAL FIELD OF THE INVENTION

The present invention relates to grips for hand-operated weapons such as but not limited to pistols and rifles, and specifically to modifications of or attachments to such grips.

BACKGROUND OF THE INVENTION

It is known in the art of hand-operated weapons such as pistols, rifles (including without limitation assault rifles, bolt-action rifles, designated marksman rifles, sniper rifles, bullpup rifles and battle rifles), machine guns, submachine guns, shotguns (including without limitation assault shotguns, semi-automatic shotguns, bullpup shotguns and pump-action shotguns), grenade launchers, support weapons and other personal defence weapons to provide such weapons with a grip portion that is both comfortable for the user and provides reliable control. Such grip portions are commonly composed of friction materials or made with textured materials to enhance the user's operation of the weapon.

Such weapons may be used by various personnel, including without limitation law enforcement, private security firms, correctional officers and military personnel. While such equipment may be a primary defence weapon for the user, other alternative defence equipment such as knives may be in use in appropriate situations. However, alternative equipment and accessories are commonly retained in the user's uniform such as in a pocket, making it difficult to access in a high-pressure, time-sensitive response situation.

What is needed, therefore, is a means for readily and quickly enabling access to other defence accessories during hand weapon operation.

SUMMARY OF THE INVENTION

The present invention is directed to a close quarters emergency defence system, or CQEDS. According to a first broad aspect of the present invention, there is provided a system for detachably mounting an accessory on a grip of a hand weapon, the accessory comprising metallic material, the system comprising:

at least one magnet; and at least one hook-and-loop fastener;

the at least one magnet for mounting on the grip to attract and retain the accessory; and the at least one hook-and-loop fastener comprising a hook portion and a loop portion, one of the hook portion and the loop portion configured for mounting on the grip and the other of the hook portion and the loop portion for mounting on the accessory.

In some exemplary embodiments of the first broad aspect, the accessory is a low-profile knife. The accessory may be provided with a cord to secure the accessory to a user. In some embodiments the grip is a sleeve configured for mounting on a handle of the hand weapon. The hand weapon may be selected from the group consisting of pistols, rifles, machine guns, submachine guns, shotguns, grenade launchers, support weapons and other personal defence weapons.

The at least one magnet is preferably two magnets, and the two magnets may be configured to be spaced apart along a long axis of the grip. The at least one magnet may be mounted on the grip with an adhesive. The at least one magnet may be mounted in a recess in the grip.

According to a second broad aspect of the present invention, there is provided a detachable sleeve configured for mounting on a grip of a hand weapon for detachably retaining an accessory thereto, the accessory comprising metallic material, the detachable sleeve comprising:

at least one magnet; and at least one hook-and-loop fastener;

the at least one magnet on the grip to attract and retain the accessory; and the at least one hook-and-loop fastener comprising a hook portion and a loop portion, one of the hook portion and the loop portion on the grip and the other of the hook portion and the loop portion for mounting on the accessory.

In some exemplary embodiments of the second broad aspect, the accessory is a low-profile knife. The accessory may be provided with a cord to secure the accessory to a user. The hand weapon may be selected from the group consisting of pistols, rifles, machine guns, submachine guns, shotguns, grenade launchers, support weapons and other personal defence weapons.

The at least one magnet is preferably two magnets, and the two magnets may be configured to be spaced apart along a long axis of the grip. The at least one magnet may be mounted on the grip with an adhesive. The at least one magnet may be mounted in a recess in the grip.

According to a third broad aspect of the present invention, there is provided a grip for a hand weapon for detachably retaining an accessory thereto, the accessory comprising metallic material, the grip comprising:

at least one magnet; and at least one hook-and-loop fastener;

the at least one magnet to attract and retain the accessory; and the at least one hook-and-loop fastener comprising a hook portion and a loop portion, one of the hook portion and the loop portion on the grip and the other of the hook portion and the loop portion for mounting on the accessory.

In some exemplary embodiments of the third broad aspect, the accessory is a low-profile knife. The accessory may be provided with a cord to secure the accessory to a user. The hand weapon may be selected from the group consisting of pistols, rifles, machine guns, submachine guns, shotguns, grenade launchers, support weapons and other personal defence weapons.

In some embodiments the at least one magnet is two magnets, and the two magnets may be configured to be spaced apart along a long axis of the grip. The at least one magnet may be mounted on the grip with an adhesive. The at least one magnet may be mounted in a recess in the grip.

A detailed description of exemplary embodiments of the present invention is given in the following. It is to be understood, however, that the invention is not to be construed as being limited to these embodiments. The exemplary embodiments are directed to particular applications of the present invention, while it will be clear to those skilled in the art that the present invention has applicability beyond the exemplary embodiments set forth herein.

BRIEF DESCRIPTION OF THE DRAWING

In the accompanying drawing, which illustrates exemplary embodiments of the present invention.

Exemplary embodiments will now be described with reference to the accompanying drawing.

DETAILED DESCRIPTION OF EXEMPLARY EMBODIMENTS

Throughout the following description, specific details are set forth in order to provide a more thorough understanding to persons skilled in the art. However, well known elements may not have been shown or described in detail to avoid unnecessarily obscuring the disclosure. The following description of examples of the invention is not intended to be exhaustive or to limit the invention to the precise form of any exemplary embodiment. Accordingly, the description and drawing are to be regarded in an illustrative, rather than a restrictive, sense.

The present invention is directed to a system for removably attaching accessories (not shown) to the grip of a hand-operated weapon such as pistols or rifles (including without limitation assault rifles, bolt-action rifles, designated marksman rifles, sniper rifles, bullpup rifles and battle rifles), machine guns, submachine guns, shotguns (including without limitation assault shotguns, semi-automatic shotguns, bullpup shotguns and pump-action shotguns), grenade launchers, support weapons and other personal defence weapons. The system comprises at least one magnet for attracting and retaining the accessory and at least one hook-and-loop fastener for further retaining the accessory and reducing any rotation of the accessory. The system may be an after-market product mountable to an existing weapon and accessory, wherein the components may be mounted using an adhesive, or it may be part of an original manufactured handle or weapon.

Figure 4A:
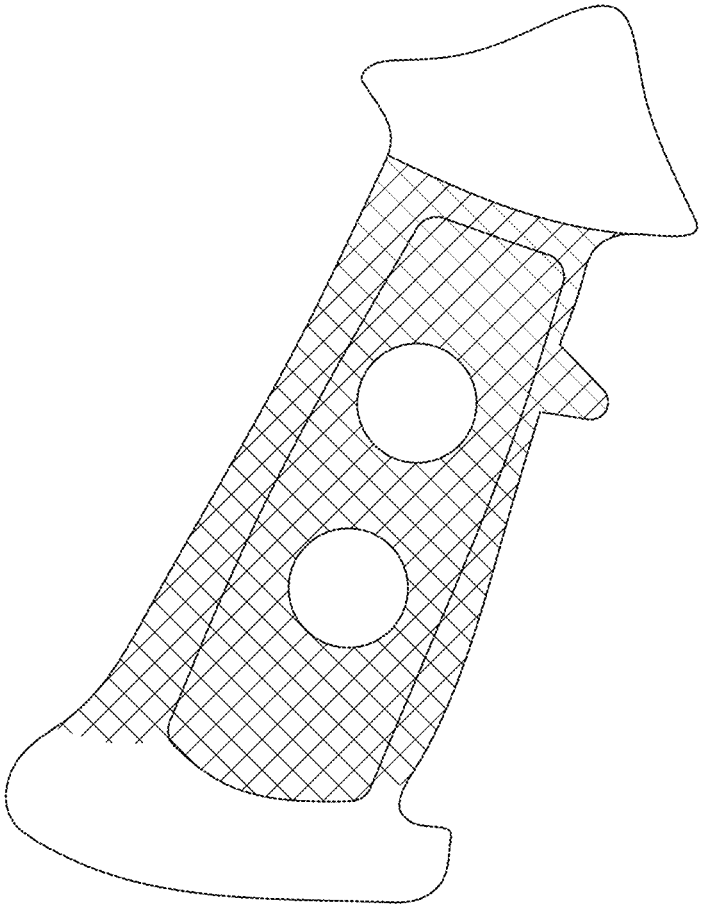
FIG. 4A to 4C are side elevation, top plan, and bottom plan views of an exemplary embodiment.
Figure 4B:
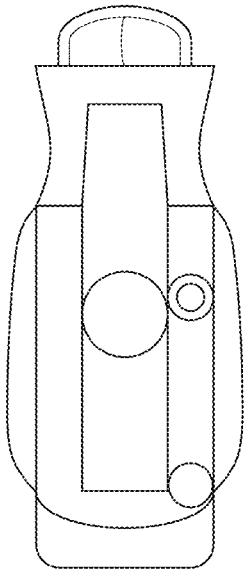
Figure 4C:
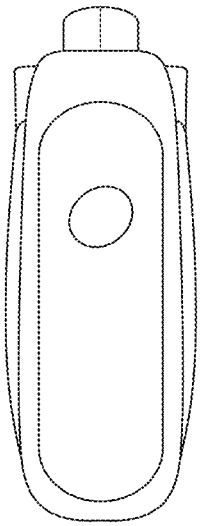

Turning now to FIGS. 1 and 2A to 2H, an exemplary system 10 is illustrated. The system is applied to a handle 12 comprising a conventional grip 14, or the exemplary embodiment may replace the conventional grip. In this exemplary embodiment, which shows the after-market product, there are two magnets 16, 18 which have been mounted on the grip 14 of the handle 12. While the magnets 16, 18 can be simply attached with a suitable adhesive to the surface of the grip 14, the grip 14 may be modified with recessed holes sized and configured for receipt of the magnets 16, 18. The magnets 16, 18 may thus be flush with the surface of the grip 14 or slightly protruding outwardly. The magnets 16, 18 are shown as circular in outward-facing shape, but they may be any suitable shape including but not limited to square, rectangular, oval, hexagonal and octagonal and combinations thereof.

Where the magnets 16, 18 are to be part of an after-market sleeve for attachment to a conventional handle 12, the sleeve can be injection-molded or 3D-printed and composed of plastic, polymer or polylactic acid (PLA). 3D-printed embodiments may use filaments selected from the group consisting of ABS, PLA, nylon, high-impact polystyrene, polyvinyl alcohol, glycol-modified polyethylene terephthalate, thermoplastic polyurethane, acrylonitrile styrene acrylate, polycarbonate, carbon fibre, conductive filament, metallic filament, wood filament, glow-in-the-dark filament and sandstone filament, or any other suitable material that would be known to the skilled person and applicable in light of the within teaching. In that case, the magnets 16, 18 could be either set in surface recesses or they could be internally situated so as to be invisible from surface viewing. Exemplary sleeves could also be made of other suitable materials such as stretchable Kevlar™, mesh, rubber, nylon, polyester, cotton, carbon fiber, tin, aluminum, and fiberglass. In some after-market sleeve embodiments, such as shown in FIG. 3A to 3H, the sleeve may be configured to wrap around the weapon grip and be secured with buttons, rivets, a zipper, or other know securing mechanisms. Exemplary sleeves may instead be configured to slide over the weapon grip and be secured due to friction and sizing the sleeve to conform to the outer surface of the weapon grip, as shown in FIG. 4A to 4C (where a flexible material is used to stretch around the grip surface)—note that while hook-and-loop fasteners are not shown in these views, other exemplary embodiments could include such fasteners as shown in FIG. 1.

Figure 1:
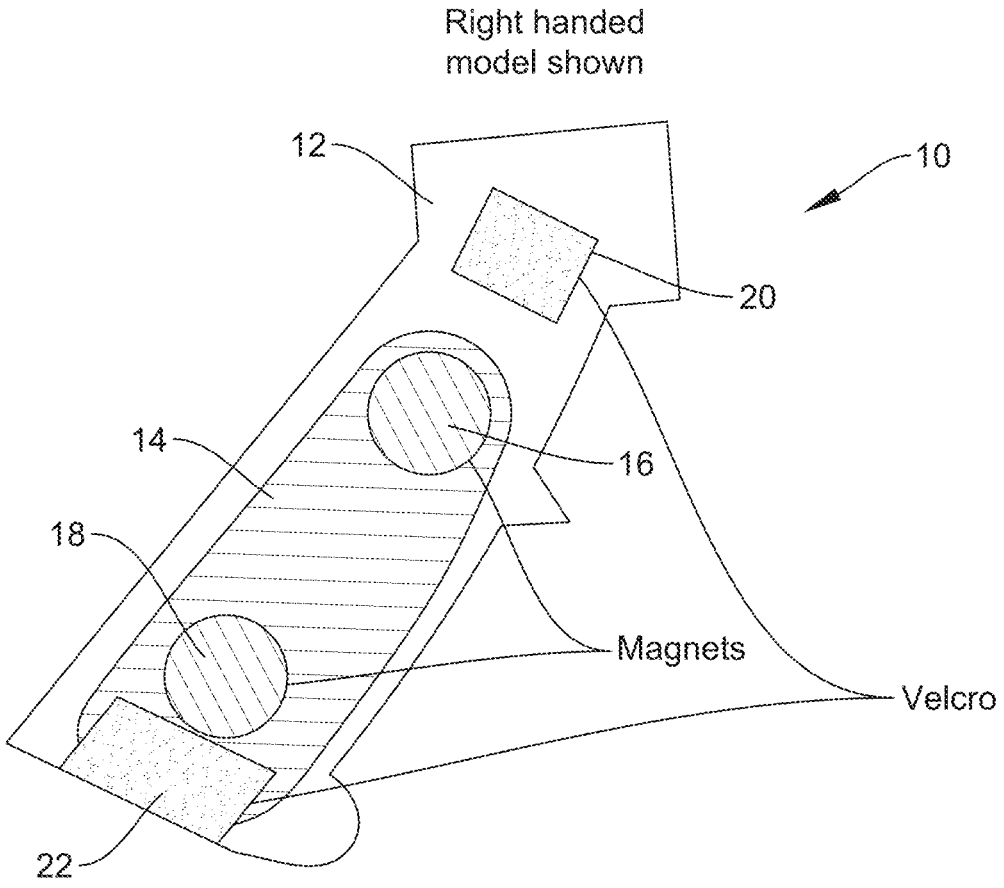
FIG. 1 is a side elevation view of an exemplary hand weapon grip with two magnets and two hook-and-loop fasteners for releasably retaining an accessory.
Figure 2A:
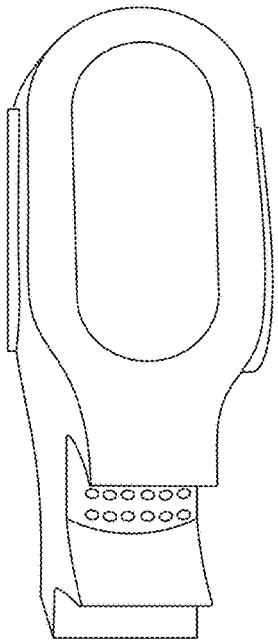
FIG. 2A to 2H are, respectively, top plan, front elevation, right side elevation, three right side perspectives, rotated left side perspective, and bottom plan views of an exemplary embodiment.
Figure 2B:
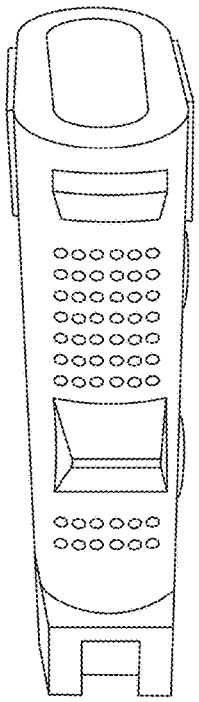
Figure 2C:
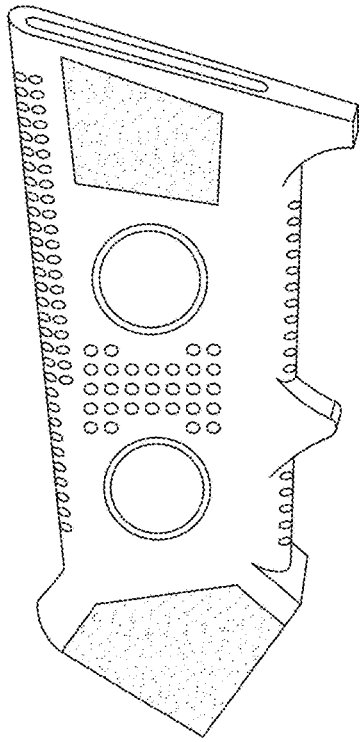
Figure 2D:
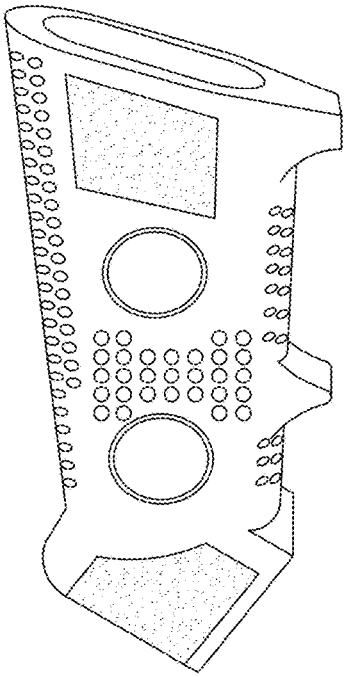
Figure 2E:
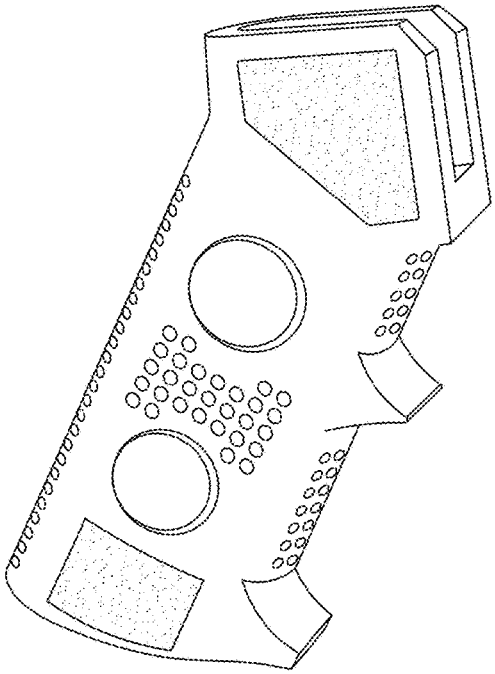
Figure 2F:
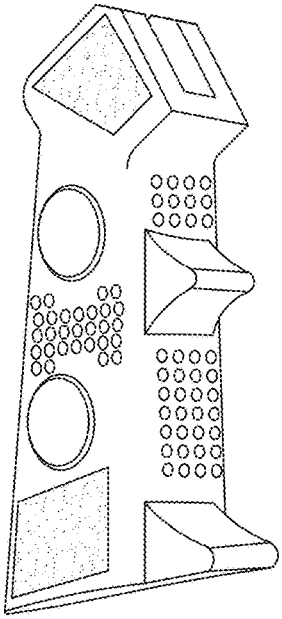
Figure 2G:
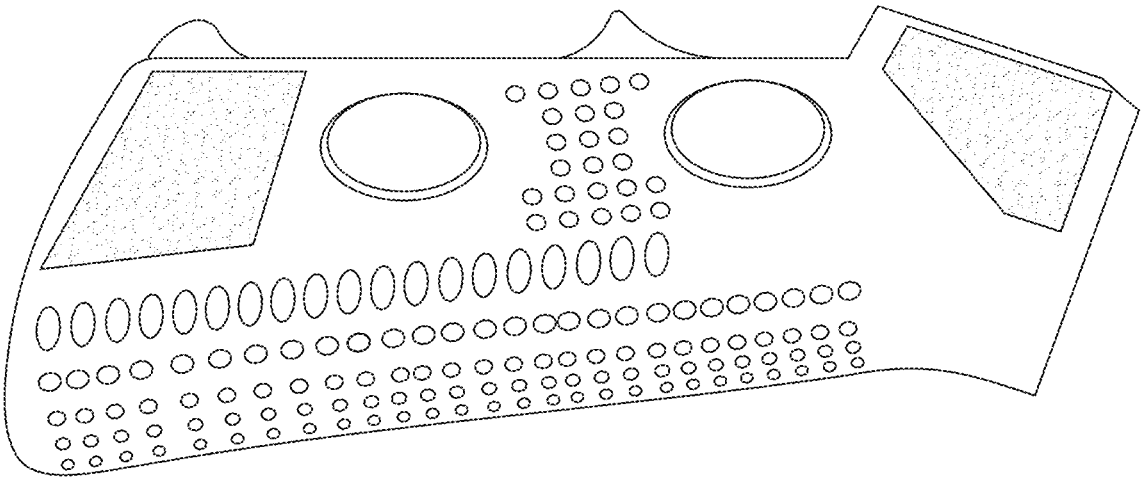
Figure 2H:
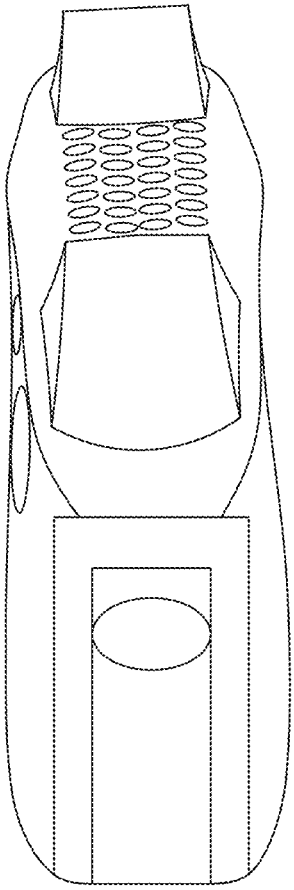
Figure 3A:
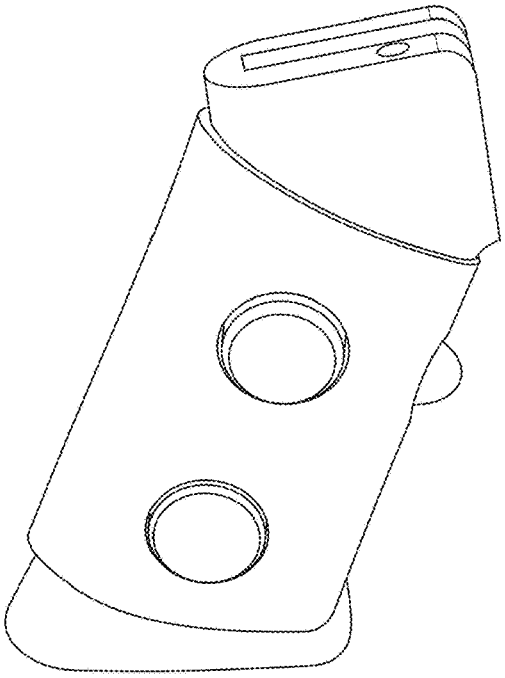
FIG. 3A to 3H are, respectively, right side perspective, left side perspective, front perspective, rear perspective, top plan, bottom plan, bottom plan reversed, and a bottom perspective views of an exemplary embodiment.
Figure 3B:
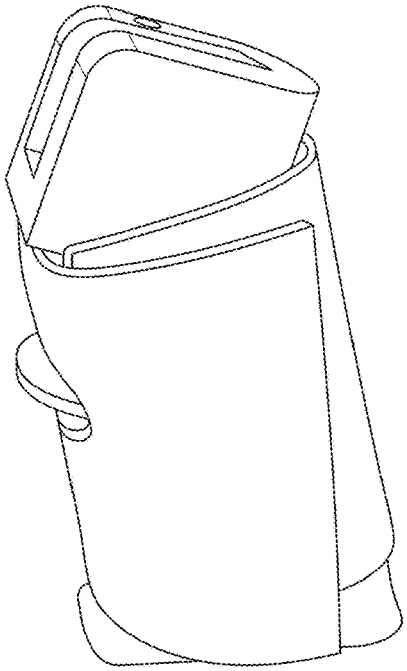
Figure 3C:
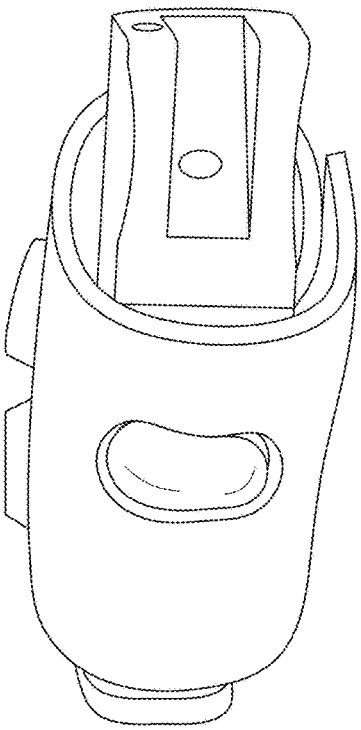
Figure 3D:
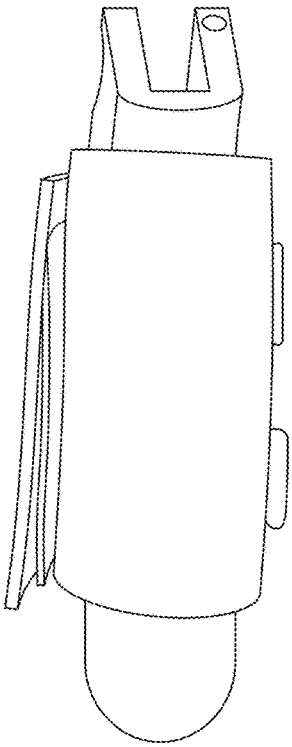
Figure 3E:
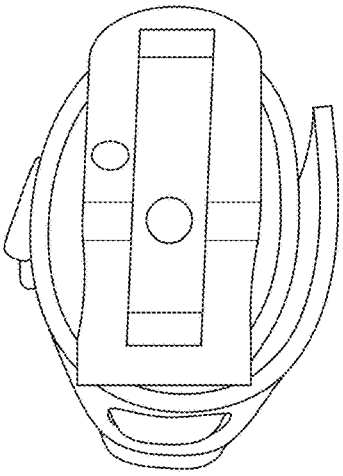
Figure 3F:
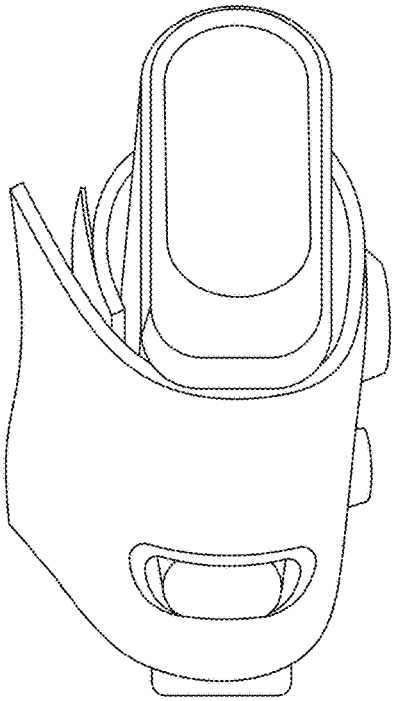
Figure 3G:
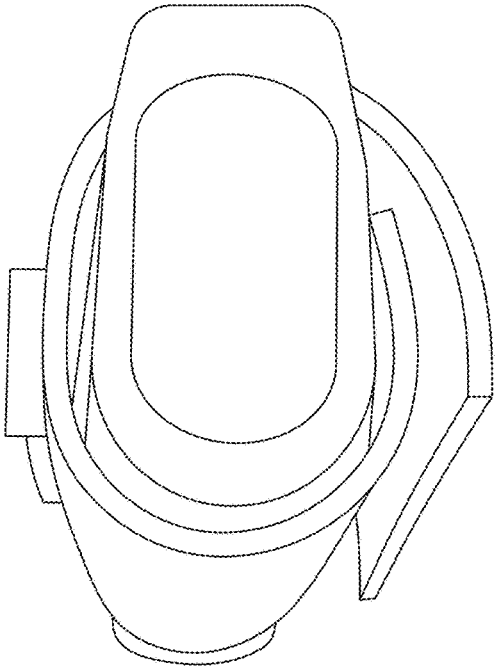
Figure 3H:
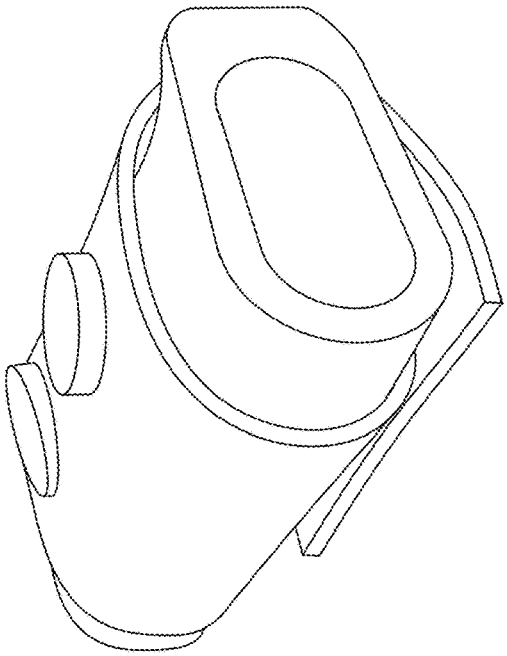

The exemplary system 10 further comprises two hook-and-loop fasteners 20, 22, which can be Velcro™ brand or any other commercially available fastener, as shown in FIG. 1 (although applicable to sleeve-type or wrap-around embodiments, as well). Each of the fasteners 20, 22 is composed of corresponding hook and loop portions, wherein either the hook portion or the loop portion is mounted on the handle 12, and the other portion is mounted on the accessory (not shown). The use of the fasteners 20, 22 helps to retain the accessory against the magnets 16, 18, but also helps to prevent rotation of the accessory when only retained by the magnets 16, 18.

In operation, an accessory comprising metallic material is selected for detachable mounting on the handle 12. The accessory could, for one non-limiting example, be a small low-profile knife. The accessory is preferably but not necessarily low-profile so as not to negatively impact use of the weapon by the user, and in some cases could be mostly concealed by the user's hand when operating the weapon. Where the accessory is concealed, it would rest between the grip 14 and the user's palm, and thus quickly accessible when needed. The accessory would be provided with either the hook or loop portion of the fasteners 20, 22, and then placed against the magnets 16, 18 to be attracted thereto, and further pressed against the fasteners 20, 22 portions on the grip 14 to further secure the accessory. The user could then access the accessory by pulling it away from the grip 14 to disengage the fasteners 20, 22 and move the accessory away from the magnets 16, 18.

In some exemplary embodiments, the accessory could be further secured by means of a cord or lanyard (not shown) between the accessory and the user's wrist. In this way, if the accessory came loose from the system 10 or was deliberately detached, risk of loss of the accessory would be reduced.

FIG. 1 shows only a single-side right-handed grip application of the exemplary embodiment, but it will be clear that the same arrangement of magnets and hook-and-loop fasteners can be applied to either side of a handle, or both sides to present a solution for ambidextrous users.

The foregoing is considered as illustrative only of the principles of the present invention. The scope of the claims should not be limited by the exemplary embodiments set forth in the foregoing, but should be given the broadest interpretation consistent with the specification as a whole.

The invention claimed is:

1. A system for detachably mounting an alternative bladed weapon on a primary hand-operated weapon, the primary hand-operated weapon comprising a grip allowing a user to hold the primary hand-operated weapon in a hand of the user and fire the primary hand-operated weapon, the alternative bladed weapon comprising metallic material, the system comprising:

at least one magnet; and at least one hook-and-loop fastener;

the at least one magnet for mounting on the grip to attract and retain the alternative bladed weapon against a side of the grip when the alternative bladed weapon is not in use by the user; and the at least one hook-and-loop fastener comprising a hook portion and a loop portion, one of the hook portion and the loop portion configured for mounting on the grip and the other of the hook portion and the loop portion for mounting on the alternative bladed weapon to prevent rotation of the alternative bladed weapon relative to the grip when mounted thereon;

such that the alternative bladed weapon when mounted on the grip is unused and at least partially concealed by the hand of the user during use of the primary hand-operated weapon; and wherein the alternative bladed weapon may be detached from the grip for close quarters use by the user instead of the primary hand-operated weapon.

2. The system of claim 1 wherein the alternative bladed weapon is a low-profile knife.

3. The system of claim 1 wherein the alternative bladed weapon is provided with a cord to secure the alternative bladed weapon to the user.

4. The system of claim 1 wherein the grip is a sleeve configured for mounting on a handle of the primary hand-operated weapon.

5. The system of claim 1 wherein the primary hand-operated weapon is selected from the group consisting of pistols, rifles, machine guns, submachine guns, shotguns, grenade launchers, support weapons and other personal weapons.

6. The system of claim 1 wherein the at least one magnet is two magnets.

7. The system of claim 6 wherein the two magnets are configured to be spaced apart along a long axis of the grip.

8. The system of claim 1 wherein the at least one magnet is mounted on the grip with an adhesive.

9. The system of claim 1 wherein the at least one magnet is mounted in a recess in the grip.

10. A detachable sleeve configured for mounting on a grip of a primary hand-operated weapon for detachably retaining an alternative bladed weapon thereto, the alternative bladed weapon comprising metallic material, the detachable sleeve comprising:

at least one magnet; and at least one hook-and-loop fastener;

the at least one magnet on the detachable sleeve to attract and retain the alternative bladed weapon against a side of the detachable sleeve; and the at least one hook-and-loop fastener comprising a hook portion and a loop portion, one of the hook portion and the loop portion on the detachable sleeve and the other of the hook portion and the loop portion for mounting on the alternative bladed weapon to prevent rotation of the alternative bladed weapon relative to the detachable sleeve when mounted thereon;

such that the alternative bladed weapon when mounted on the detachable sleeve is unused and partially concealed by a hand of a user during use of the primary hand-operated weapon; and wherein the alternative bladed weapon may be detached from the detachable sleeve for use by the user.

11. The detachable sleeve of claim 10 wherein the alternative bladed weapon is a low-profile knife.

12. The detachable sleeve of claim 10 wherein the alternative bladed weapon is provided with a cord to secure the alternative bladed weapon to the user.

13. The detachable sleeve of claim 10 wherein the primary hand-operated weapon is selected from the group consisting of pistols, rifles, machine guns, submachine guns, shotguns, grenade launchers, support weapons and other personal weapons.

14. The detachable sleeve of claim 10 wherein the at least one magnet is two magnets.

15. The detachable sleeve of claim 14 wherein the two magnets are configured to be spaced apart along a long axis of the detachable sleeve.

16. The detachable sleeve of claim 10 wherein the at least one magnet is mounted on the detachable sleeve with an adhesive.

17. The detachable sleeve of claim 10 wherein the at least one magnet is mounted in a recess in the detachable sleeve.

18. A grip for a primary hand-operated weapon for detachably retaining an alternative bladed weapon thereto, the alternative bladed weapon comprising metallic material, the grip comprising:

at least one magnet; and at least one hook-and-loop fastener;

the at least one magnet to attract and retain the alternative bladed weapon against a side of the grip; and the at least one hook-and-loop fastener comprising a hook portion and a loop portion, one of the hook portion and the loop portion on the grip and the other of the hook portion and the loop portion for mounting on the alternative bladed weapon to prevent rotation of the alternative bladed weapon relative to the grip when mounted thereon;

such that the alternative bladed weapon when mounted on the grip is unused and partially concealed by a hand of a user during use of the primary hand-operated weapon; and wherein the alternative bladed weapon may be detached from the grip for use by the user.

19. The grip of claim 18 wherein the alternative bladed weapon is a low-profile knife.

20. The grip of claim 18 wherein the alternative bladed weapon is provided with a cord to secure the alternative bladed weapon to the user.

21. The grip of claim 18 wherein the primary hand-operated weapon is selected from the group consisting of pistols, rifles, machine guns, submachine guns, shotguns, grenade launchers, support weapons and other personal weapons.

22. The grip of claim 18 wherein the at least one magnet is two magnets.

23. The grip of claim 22 wherein the two magnets are configured to be spaced apart along a long axis of the grip.

24. The grip of claim 18 wherein the at least one magnet is mounted on the grip with an adhesive.

25. The grip of claim 18 wherein the at least one magnet is mounted in a recess in the grip.

* * * * *